US006644204B2

(12) United States Patent
Pierrot et al.

(10) Patent No.: US 6,644,204 B2
(45) Date of Patent: Nov. 11, 2003

(54) BASE FOR AMMUNITION INTENDED TO RECEIVE AN ELECTRICAL IGNITER SQUIB

(75) Inventors: Jean François Pierrot, Saint Doulchard (FR); Jean Luc Taillandier, Fussy (FR)

(73) Assignee: Giat Industries (FR)

( * ) Notice: Subject to any disclaimer, the term of this patent is extended or adjusted under 35 U.S.C. 154(b) by 0 days.

(21) Appl. No.: 10/145,136

(22) Filed: May 15, 2002

(65) Prior Publication Data

US 2002/0170455 A1 Nov. 21, 2002

(30) Foreign Application Priority Data

May 18, 2001 (FR) ..... 01 06688

(51) Int. Cl.[7] ..... F42B 5/08; F42B 5/18

(52) U.S. Cl. ..... 102/472; 102/430; 102/431; 102/467

(58) Field of Search ..... 102/202, 202.9, 102/430–433, 464, 467, 469, 470, 472, 700, 202.14; 89/8

(56) References Cited

U.S. PATENT DOCUMENTS 5,044,278 A * 9/1991 Campbell ..... 102/472

FOREIGN PATENT DOCUMENTS

| | | |
|---|---|---|
| DE | 198 53 291 | 5/2000 |
| EP | 0 310 517 | 4/1989 |
| GB | 2 056 631 | 3/1981 |
| WO | WO 95/30874 | 11/1995 |

* cited by examiner

*Primary Examiner*—Harold J. Tudor
(74) *Attorney, Agent, or Firm*—Parkhurst & Wendel, L.L.P.

(57) ABSTRACT

An ammunition base with an electrical igniter located in an axial bore within a cylindrical base, wherein the base is made of a metallic material coated with an electrically insulating material and has at least one non-insulated conductive area constituted by a ring-shaped bearing area of a shoulder of the base or by at least one non-insulated conductive ring crimped into a housing arranged in the base.

10 Claims, 4 Drawing Sheets

BASE FOR AMMUNITION INTENDED TO RECEIVE AN ELECTRICAL IGNITER SQUIB

BACKGROUND OF THE INVENTION

The technical scope of the present invention is that of bases for ammunition intended to receive an electrical igniter.

Such bases are generally integral with an ammunition case and are intended to ensure gas-tightness with respect to the propellant gases upon firing.

When these bases are fitted with an electrical igniter the problem of the electrical contact between the igniter and the weapon system arises.

If such igniters generally incorporate an axial contact disc ensuring current lead-in, the reverse current generally occurs by means of the projectile in contact with the weapon's ground.

Such a solution has numerous drawbacks.

First of all, the quality of the reverse electrical contact between the projectile and the weapon varies from one piece of ammunition to another and strongly depends on the surface smoothness of the weapon and the projectile as well as on any deposited impurities (namely any non-burned residue) they may carry.

Moreover, when the weapon's ground is used as a reverse conductor the problem of electrical insulation arises. The weapon is live when a piece of ammunition is being ignited, which may deteriorate the equipment, namely the electronic equipment, integral with the weapon and notably risks harming the weapon crew.

This risk is all the greater and all the less acceptable in that the supply voltage of the igniter is high. Future weapon systems, however, will use high voltage electrical igniters in the form of one or several plasma torches or squibs. The voltages implemented will in this case be of around a few tens of kilo volts.

Such a reverse current via the weapon's ground is thus complicated to achieve and the definition of an igniter having two current lead-in contacts at its rear causes problems of electrical insulation between these two contacts, which are too close to one another. There is the risk that the electric arc, in this case, will be produced at the contacts and not inside the igniter.

SUMMARY OF THE INVENTION

The aim of the present invention is to propose a base for ammunition that overcomes such drawbacks.

Thus, the invention relates to an ammunition base intended to receive an electrical igniter arranged in an axial bore, said base wherein it is made of a metallic material coated with an insulating material and in that it incorporates at least one non-insulated conductive area constituted by a ring-shaped bearing area of a shoulder of the base or by at least one non-insulated conductive ring crimped into a housing arranged in the base.

According to another characteristic of the invention, the axial bore incorporates female threading intended to ensure the attachment of the igniter, the female threading being free of insulating material and providing an electrical connection between the non-insulated conductive area and the igniter through the material of the base.

The insulating material may be a plastic or organic material.

The ring housing may be a circular groove made in a rear face of the base.

The housing may have a trapezoidal section profile.

The conductive ring may be made of copper or brass.

The conductive area, and namely the ring-shaped bearing area of a shoulder of the base, may have a metallic coating of copper or copper alloy.

The base according to the invention may advantageously carry an electric igniter comprising at least one plasma igniter.

Thus, the base according to the invention ensures a reliable electrical connection between an electrical igniter and a weapon system whilst providing an excellent level of electrical insulation. The contact resistance present at a base according to the invention is both low and reproducible from one base to another.

BRIEF DESCRIPTION OF THE DRAWINGS

The invention will be better understood upon reading the following description of an embodiment of the invention, such description made with reference to the appended drawings in which.

DETAILED DESCRIPTION OF PREFERRED EMBODIMENTS

Figure 1:
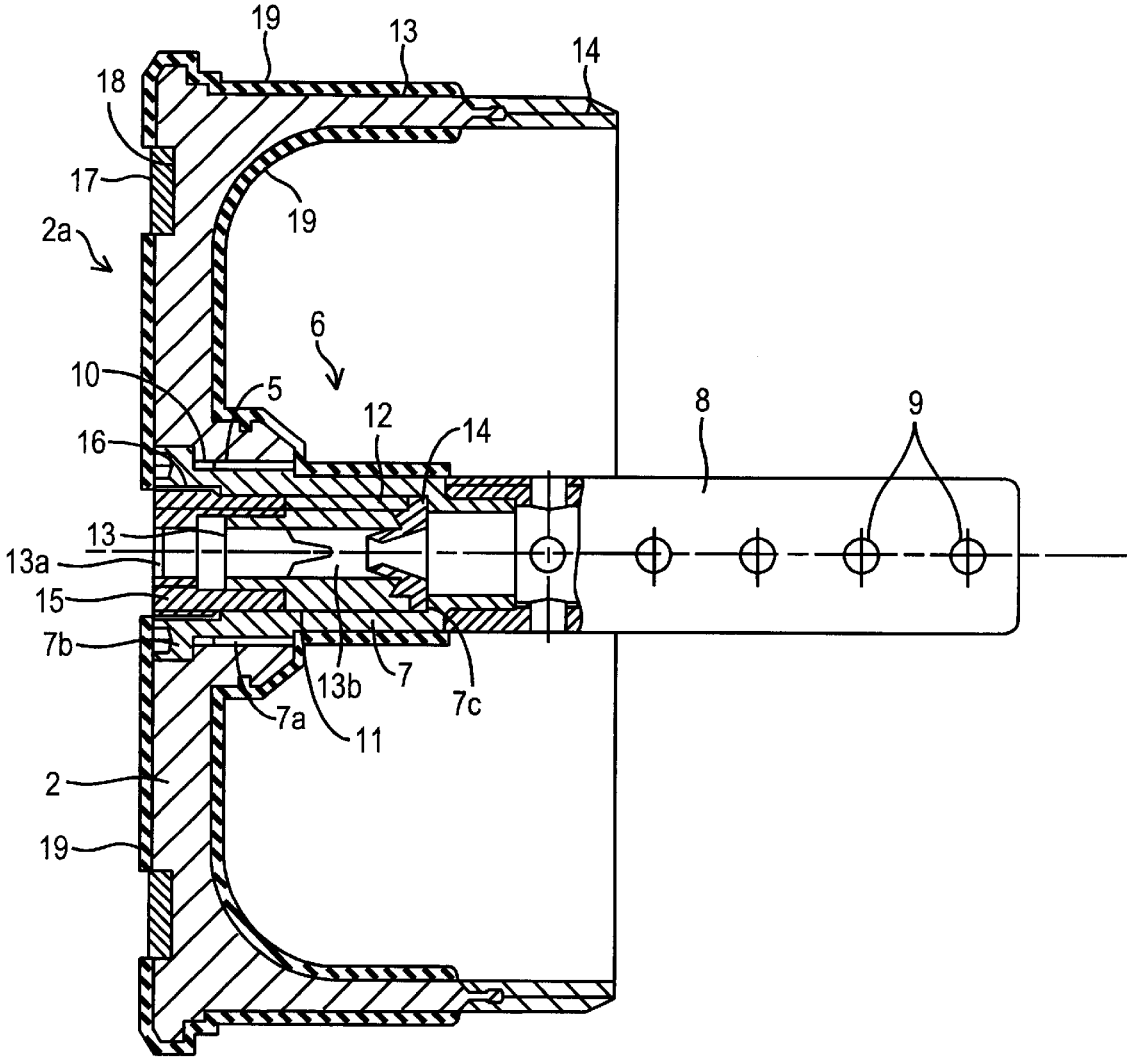
FIG. 1 shows a longitudinal section view of a base according to a first embodiment of the invention equipped with an electric igniter.
Figure 2:
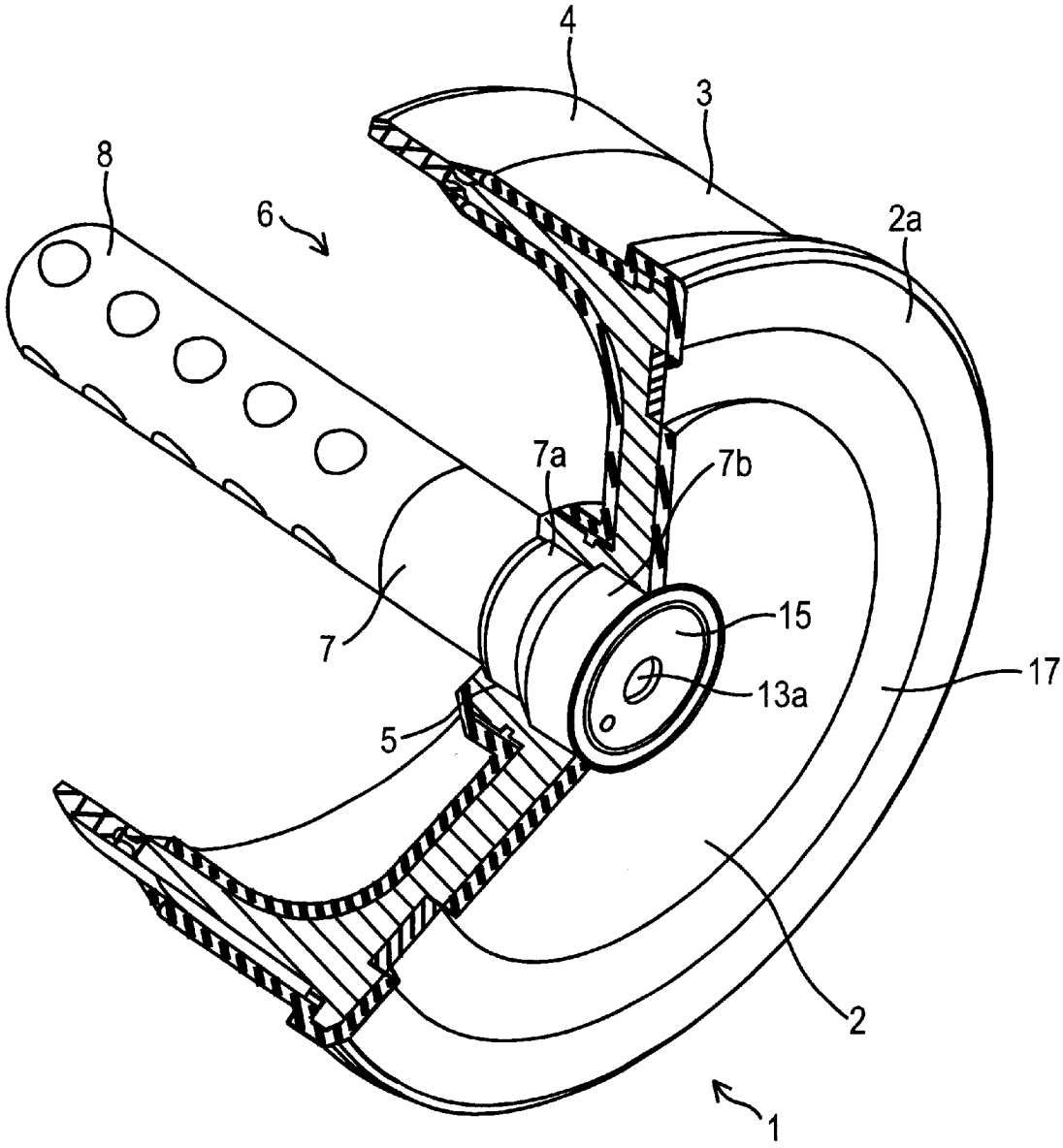
FIG. 2 shows a partly torn away rear perspective view of this base.

With reference to FIG. 1, the base 1 according to a first embodiment of the invention incorporates a solid bottom 2 and a cylindrical rim 3 at the end of which a rubber sealing lip 4 has been placed.

This base is intended to be attached to an ammunition case, not shown, classically enclosing a propellant charge and carrying a projectile.

The base 1 has a threaded axial bore 5 that receives an igniter 6.

The igniter 6 shown here is a plasma igniter. This comprises a metallic tubular body 7 extended by a nozzle 8 for the plasma generated. This nozzle is pierced with radial holes 9.

The body 7 has threading 7*a* allowing it to be fixed in the female threading 5 in the base. The rear part 7*b* of the body 7 has an enlarged diameter and constitutes an axial abutment collar housed in a counter-sink 10 in the base.

The body 7 has an axial bore 11 inside which an insulating cylindrical casing 12 is placed made of an ablatable plastic material, that is a material able to generate light gases through the action of a plasma. The casing 12 may, for example, be made of polyoxymethylene or polytetrafluorethylene. Or the casing 12 may be made of an energetic material, for example nitrocellulose.

Such a casing is generally called a capillary tube in known plasma torches.

Two metallic electrodes 13 and 14 (made for example of a copper-based alloy), are separated by the insulating casing 12.

A rear electrode 13, globally cylindrical and having the same axis as the body 7, extends inside the casing 12.

It has a rear end 13*a* that is slightly set back with respect to the rear face of the igniter. This rear end forms a contact disc allowing the lead-in of the electrical current from a mobile contact integral with the weapon and not shown.

The front end 13*b* of the rear electrode forms a tip allowing a foot to be constituted for the electric arc that will generate the plasma.

A front ring-shaped electrode 14 is applied against an inner counter-sink 7*c* in the body 7. It has a peripheral shoulder that is tightly fitted to the body 7.

The front 14 and rear 13 electrodes are axially separated by a distance selected such that (for the selected electrical voltage) the electrical field between the electrodes is of the magnitude of 1 Megavolt/meter. By way of example, for a voltage between electrodes of 10,000 Volts, the distance will be of 10 mm.

The rear electrode 13 is held axially with respect to the body 7 by an insulating sleeve 15 having threading 16 allowing it to be screwed into rear female threading in the body 7. The sleeve presses on a shoulder of the rear electrode 13 and applies this against the casing 12, itself pressing on the front electrode 14.

The sleeve 15 is made of a high strength insulating material, for example polyoxymethylene.

The air gap-based plasma igniter shown here is described in greater detail in the application for patent FR00.04735.

This is not the subject of the present invention and may be replaced by another type of igniter, for example a fusible wire-based plasma igniter such as those described in U.S. Pat. Nos. 5,355,764, 5,503,081 or EP905470.

The plasma igniter might also be replaced by another type of electrical igniter, for example hot wire, exploded wire, semi-conductive bridge or else projected layer (more commonly known as "slapper") igniters.

These different igniters all have in common the fact that they incorporate firstly an axial contact disc for the current lead-in and secondly a conductive body 7 allowing the reverse current and incorporating threading.

According to this embodiment of the invention, the base 1 is made of a metallic material and incorporates at least one conductive ring 17. This ring 17 is crimped into a housing 18 arranged in the base. The ring will be made of a malleable material having reduced electrical resistance, for example copper or brass. The ring will be set into position in its housing by cold deformation of the ring in its housing using a press.

The ring, like the contact disc 13*a*, is intended to cooperate with a mobile contact integral with a weapon system (not shown). The circular shape of the ring avoids any angular indexing constraint with respect to the weapon.

The housing 18 for the ring 17 is a circular groove machined in a rear face 2*a* of the bottom 2 of the base 1.

The housing 18 for the ring 17 is a circular groove 20 machined in a rear face 2*a* of the bottom 2 of the base 1.

Figure 4:
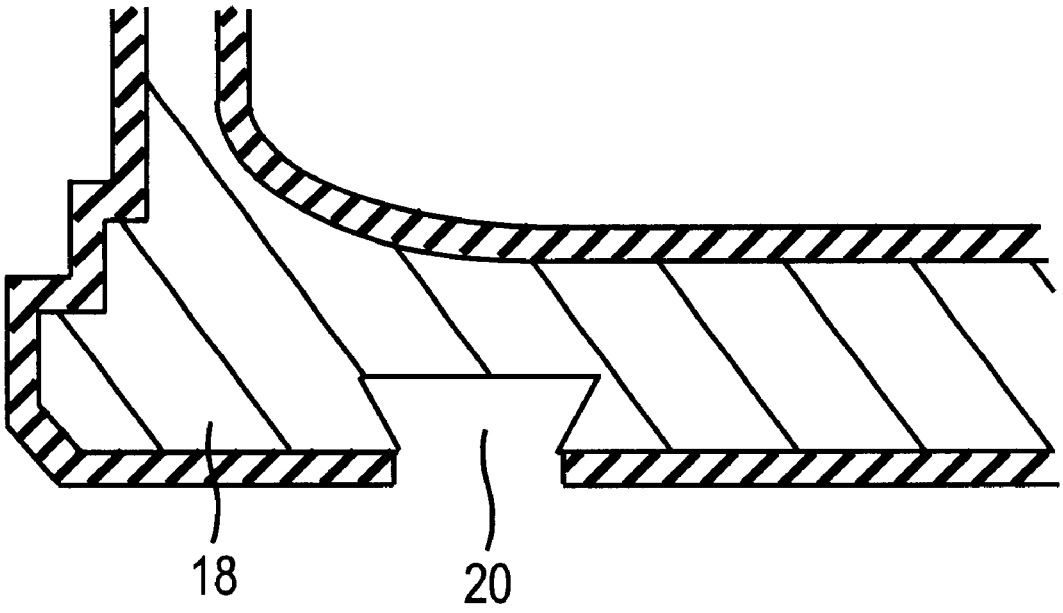
FIG. 4 shows a magnified partial view of the base shown in FIG. 1.

FIG. 4 shows a magnified partial view of the housing shown in FIG. 1, wherein the depth in relation to the width of the groove is exaggerated to more clearly show the features of the groove. FIG. 4 shows circular groove 20 having a trapezoidal section profile wherein the walls in a depth direction of the groove form less than a right angle with an outer surface of rear face 2*a* of housing 18, for providing an interference fit with the ring 17. Such an arrangement enables the ring to be hooked with the base whilst reducing the electrical resistance of the contact between the ring and the base.

According to another characteristic of the invention, the base 1 is coated by an insulating material 19 that substantially covers all its surface with the exception of the ring 17 and the axial female threading 5.

This insulating material will, for example, be a deposit under vacuum of 30 to 80 micrometers of a plastic material such as polytetrafluorethylene (PTFE) or else another organic insulating material, such as di-para-zylylene (DPXN).

Such an arrangement allows the electrical insulation of the torch to be improved. Indeed, no inadvertent reverse current can be produced between the external surface of the base and the weapon system.

Advantageously, the insulating deposit will be made after the ring 17 and the igniter 6 have been set into place. Thus, it will also cover the external surface of the igniter body 7 and the transitional areas between the base and the igniter. A protective film (for example, of self-adhesive plastic) will be placed on the electrical contacts (ring 17 and disc 13*a*) before the insulating material 19 is deposited. This protection will be removed by hand after the insulating deposit has been made, or else before the base is used.

Thus, when the base is introduced into an appropriate weapon system (not shown), a first mobile contact presses against the axial disc 13*a* and a second mobile contact presses on the ring 17.

These mobile contacts will, for example, be carried by the breech closing the weapon chamber.

The radial distance between the ring 17 and the axial disc 13*a* is of around 50 mm for a caliber of 120 mm. There is therefore no risk of seeing an electric arc appear directly between the ring and disc for a voltage of between 10 and 30 kilo volts.

The current flows from the weapon system to the front electrode 14 by means of the ring 17, the conductive ground of the base 1, and the conductive body 7 of the igniter.

The electrical contact resistance is strongly reduced between the ring 17 and the base 1 because of the mutual contact surface between these elements, which is substantial, and the positioning process which additionally providing a close contact between the ring 17 and the base 1.

The electrical contact resistance is also strongly reduced between the base 1 and the body 7 of the igniter. Indeed, the current flows through the matching threading 7*a* and 5, the contact surfaces being once again relatively substantial and the tight fit ensuring the quality of the electrical contact.

Different variants are possible without departing from the scope of the invention. It is notably possible for the contact ring 17 to be positioned in a groove arranged in the cylindrical rim 3 of the base, rather than in its rear face. This ring will therefore co-operate with a contact disc carried by the weapon chamber.

Several concentric contact rings may also be provided carried by the rear face 2*a* of the base.

Figure 3:
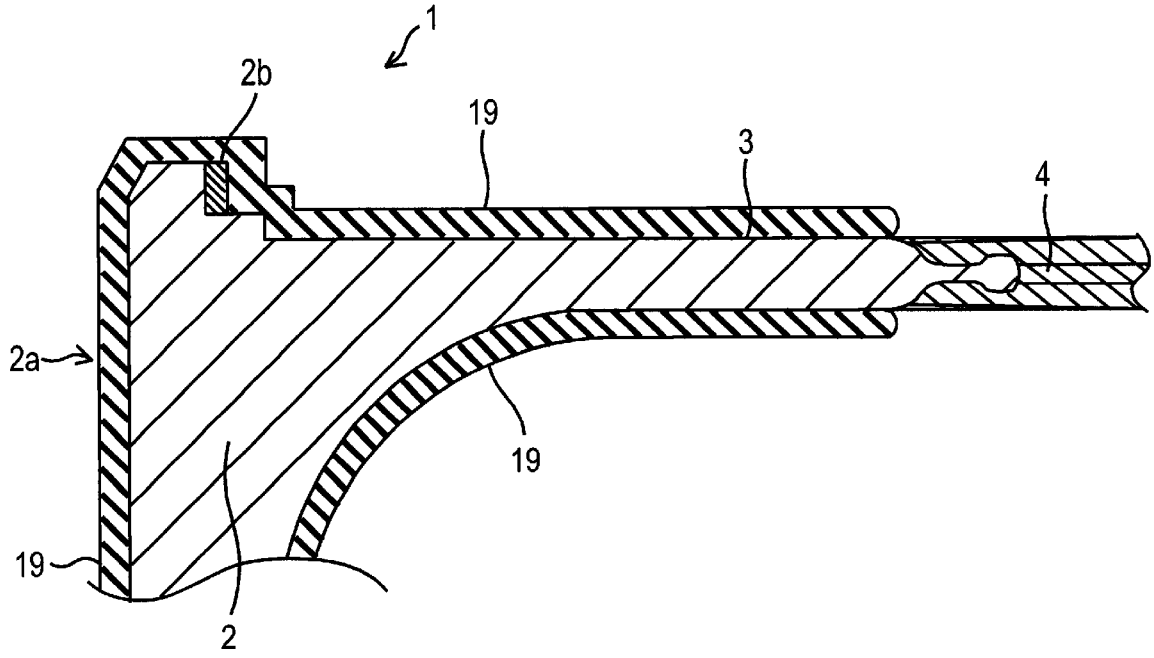
FIG. 3 shows a longitudinal section view of a base according to a second embodiment of the invention.

FIG. 3 schematically shows another embodiment of a base according to the invention.

This base differs from the previous one in that its rear face has no conductive ring 17. The reverse current is thus carried out via a conductive area constituted by a ring-shaped bearing face 2*b* of a shoulder of the base, said area being intended to press against a conductive surface of the weapon chamber or else preferably on a contact disc carried by the weapon.

To reduce the electrical contact resistance, the bearing surface 2*b* of the shoulder is coated with a copper deposit. The rest of the external surface of the base 1 is coated with an insulating material 19. As in the previous embodiment, a plastic material such as polytetrafluorethylene (PTFE) or di-para-zylylene (DPXN) may be used.

As in the previous embodiment, the current will reach the igniter by means of the conductive ground of the base and the conductive body of the igniter, the electrical contact between these two elements being obtained by the threaded base/igniter connection.

The reverse current will be made via the axial contact disc of the igniter.

This embodiment of the invention is more particularly adapted to small or medium caliber ammunition (less than 50 mm).

What is claimed is:

1. An ammunition base with electrical igniter, comprising:

an electrical igniter;

a base comprising a bottom and a cylindrical rim attached to said bottom, said bottom having an axial bore containing the electrical igniter, wherein said base comprises a metallic material coated on substantially all its surfaces with an electrically insulating material and said base has at least one non-insulated conductive area comprising at least one non-insulated conductive ring crimped into a housing in said base or a ring-shaped bearing area on a shoulder on said bottom.

2. The base according to claim 1, wherein said axial bore comprises female threading for attachment of said igniter, said female threading being free of insulating material and providing an electrical connection between said non-insulated conductive area and said igniter through the metallic material of said base.

3. The base according to claim 1, wherein said insulating material is a plastic or organic material.

4. The base according to claim 2, wherein said insulating material is a plastic or organic material.

5. The base according to claim 1, wherein said housing is a circular groove located in a rear face of said bottom.

6. The base according to claim 2, wherein said housing is a circular groove located in a rear face of bottom.

7. The base according to claim 1, wherein said housing is a circular groove having a cross-section profile.

8. The base according to claim 1, wherein said conductive ring comprises copper or brass.

9. The base according to claim 1, wherein said bearing area comprises a metallic coating of copper or copper alloy.

10. The base according to claim 1, wherein said electric igniter comprises at least one plasma igniter.

* * * * *